US006571814B2

(12) United States Patent
You

(10) Patent No.: US 6,571,814 B2
(45) Date of Patent: Jun. 3, 2003

(54) WINDPROOF UMBRELLA

(76) Inventor: Ching-Chuan You, c/o Percy International Patent Corp. P.O. Box 1-79, Taipei (TW)

( * ) Notice: Subject to any disclaimer, the term of this patent is extended or adjusted under 35 U.S.C. 154(b) by 0 days.

(21) Appl. No.: 09/791,695

(22) Filed: Feb. 26, 2001

(65) Prior Publication Data

US 2002/0117195 A1 Aug. 29, 2002

(51) Int. Cl.[7] ..... A45B 25/26

(52) U.S. Cl. ..... 135/33.7; 135/15.1; D3/5; D3/6

(58) Field of Search ..... 135/33.7, 33.2, 135/27, 15.1; D3/5, 6

(56) References Cited

U.S. PATENT DOCUMENTS 212,457 A * 2/1879 Girbardt ..... 135/33.7
D47,559 S * 7/1915 Henderson
D370,556 S * 6/1996 Yu
D383,900 S * 9/1997 Bart
6,006,769 A * 12/1999 Lin ..... 135/33.7
6,155,278 A * 12/2000 Lin ..... 135/33.7
6,170,499 B1 * 1/2001 Lin ..... 135/33.7
6,202,662 B1 * 3/2001 Lin ..... 135/33.7
6,250,319 B1 * 6/2001 You ..... 135/33.7
6,318,391 B1 * 11/2001 You ..... 135/33.7

* cited by examiner

*Primary Examiner*—Robert Canfield
(74) *Attorney, Agent, or Firm*—Troxell Law Office PLLC

(57) ABSTRACT

A windproof umbrella comprises a canopy including an upper canopy, a lower canopy not equal to upper canopy in size, and a vent hole provided in the center portion of the lower canopy; and a multiple frame including a shank, stationary hubs fixed on the shank, rings slidable along the shank, ribs for supporting canopy, and spreaders. Air beneath the lower canopy exits through a gap formed between upper and lower canopies when frame is stretched. Also, rings moves synchronously along the shank such that the stretching and folding of upper and lower canopies can be smooth and synchronous.

3 Claims, 7 Drawing Sheets

WINDPROOF UMBRELLA

BACKGROUND OF THE INVENTION

1. Field of the Invention

The present invention relates to umbrellas, and more particularly to umbrella with double canopy and frame which is windproof and capable of ventilating by the provision of vent hole.

2. Description of Related Art

Conventionally, umbrella is carried by people to protect against rain and sun. Also, umbrella is foldable for ease of storage and carrying.

Typically, canopy of umbrella is a single layer of thick opaque cloth. As such, the capability of letting air through is poor of such umbrella. Thus, umbrella user may have a muggy unpleasant feeling when holds such umbrella walking under hot sun. This condition is worse when a person sits under an umbrella in the beach. Further, a wind will catch an umbrella user unaware and exert a force against the inner surface of the canopy which will cause the canopy to invert from its normal operable position to an upwardly convex position.

An analysis of above drawbacks is detailed below.

1. As to the muggy unpleasant feeling when holding such umbrella under hot sun, the cause of this is that umbrella is formed as a blockage to the ventilation between the air above the umbrella and the air beneath the umbrella.
2. As to the inversion of umbrella in a windy day, the cause of this is that no provision of vents on the canopy to release pressure of the strong wind beneath umbrella.

Thus, it is desirable to provide a novel and improved windproof umbrella with double canopy with a frame in order to overcome the above drawbacks of prior art.

SUMMARY OF THE INVENTION

It is an object of the present invention to provide a windproof umbrella with double canopy and a frame having the provision of vent hole for releasing the pressure of the strong wind beneath umbrella, thus preventing inversion.

It is another object of the present invention to provide a windproof umbrella with double canopy and a frame having the provision of a lower canopy and an upper canopy in covering relation to the lower canopy wherein the sector of upper and lower canopies are alternate and supported by a set of frame such that an aesthetic purpose can be achieved when the upper and lower canopies are vibrated in the wind.

It is still another object of the present invention to provide a windproof umbrella with double canopy and a frame wherein the open ends of spreaders of each frame are equally spaced around the periphery of umbrella and the other ends thereof are attached to rings which is slidable along the shank such that the stretching and folding of upper canopy and lower canopy can be smooth and synchronous.

To achieve the above and other objects, the present invention provides a windproof umbrella comprising a canopy including an upper canopy and a lower canopy; a vent hole provided in the center portion of the lower canopy; and a multiple frame including a shank, a stationary hub, a ring slidable along the shank, a plurality of first ribs for supporting the upper canopy having one ends attached to the stationary hub, a plurality of second ribs for supporting the lower canopy also having one ends attached to the stationary hub, a plurality of first spreaders having one ends attached to the ring, and a plurality of second spreaders also having one ends attached to the ring; wherein air beneath the lower canopy exits through a gap formed between upper and lower canopies when frame is stretched; and the other open ends of the first ribs, the second ribs, the first spreaders, and the second spreaders are equally spaced around the periphery of the umbrella such that the stretching and the folding of the upper canopy and the lower canopy can be smooth and synchronous.

The above and other objects, features and advantages of the present invention will become apparent from the following detailed description taken with the accompanying drawings.

DETAILED DESCRIPTION OF THE PREFERRED EMBODIMENTS

Figure 1:
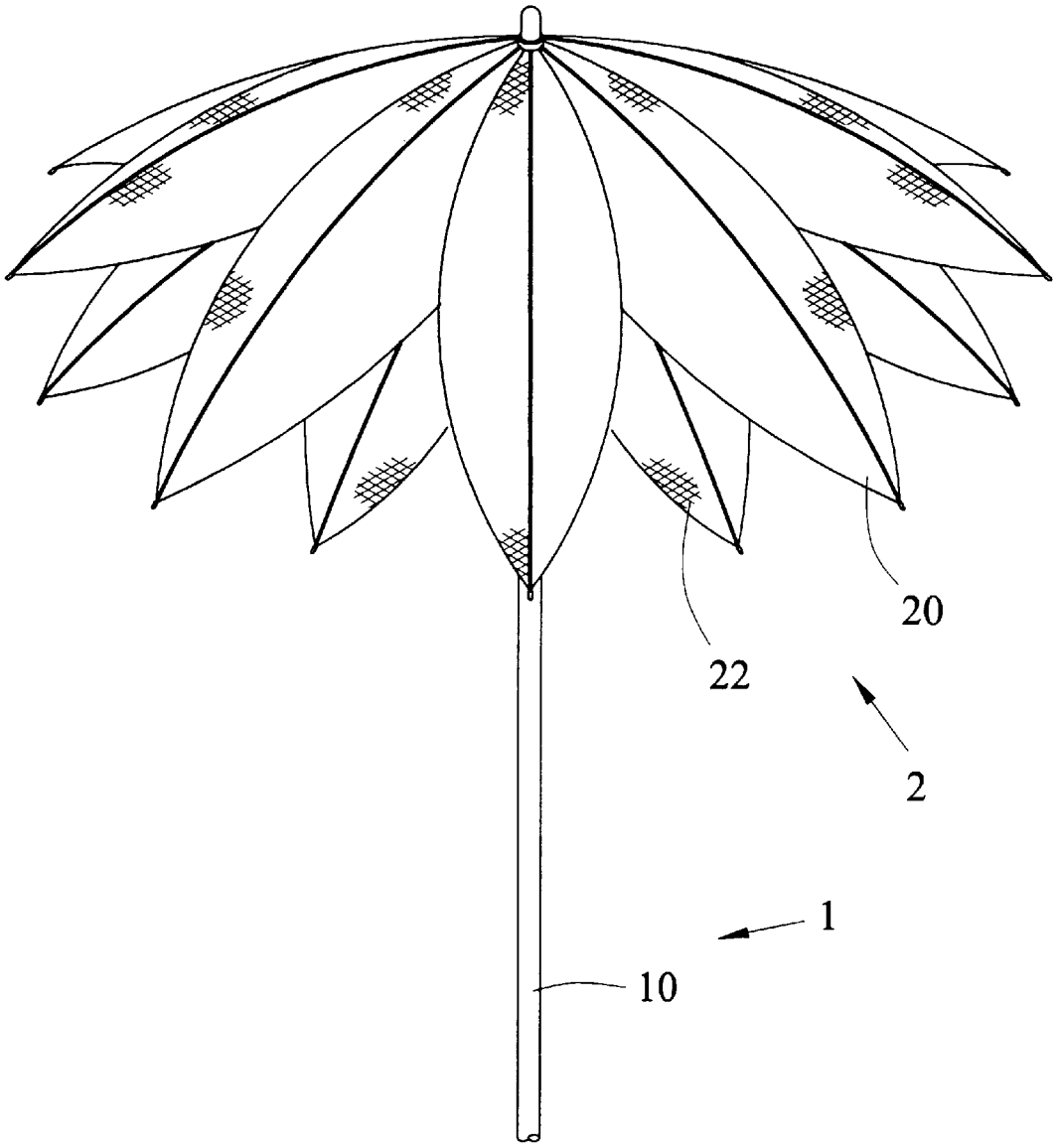
FIG. 1 is a perspective view of a first preferred embodiment of windproof umbrella with multiple canopy and frame according to the invention.
Figure 2:
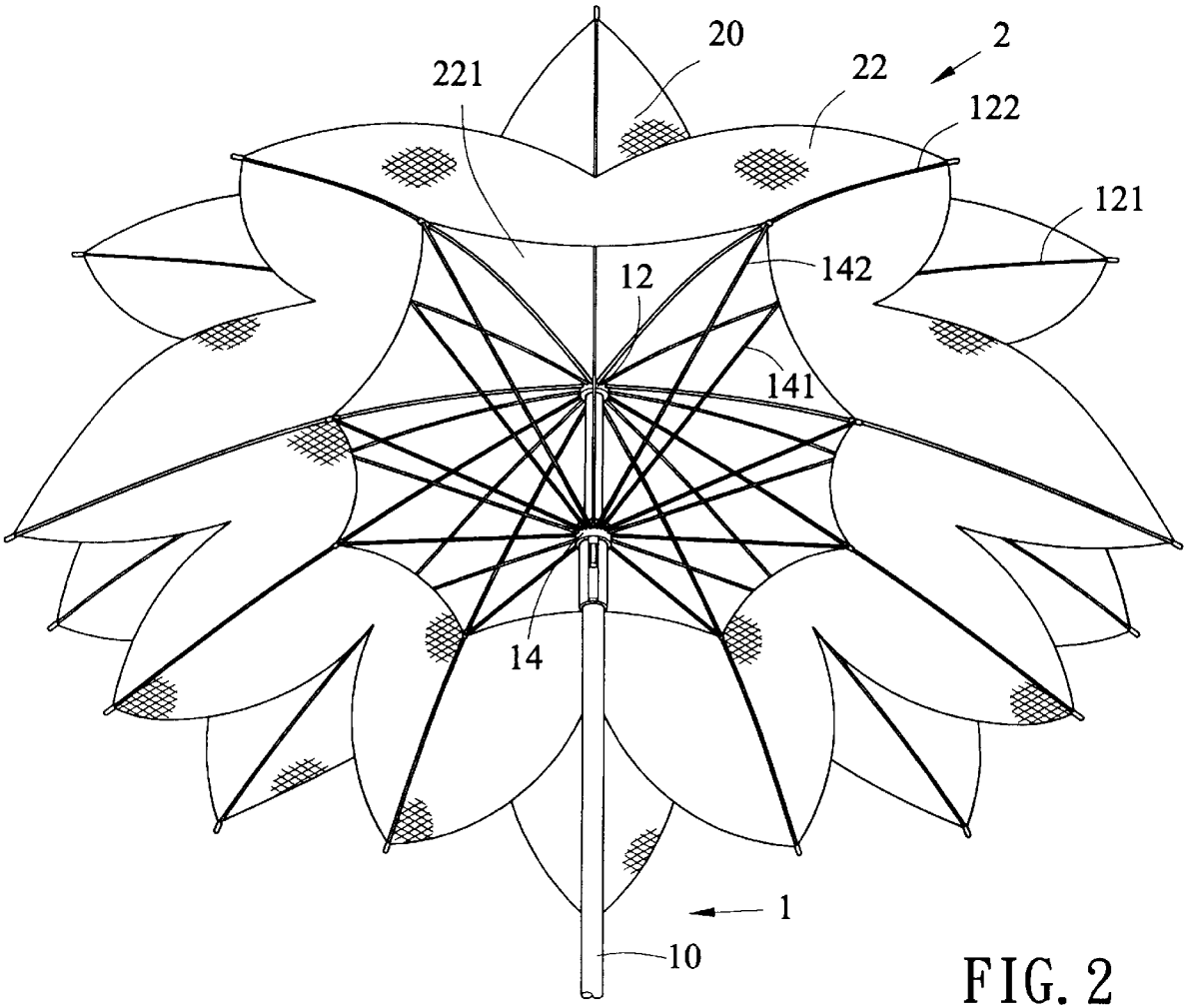
FIG. 2 is another perspective view of the umbrella of FIG. 1, viewed from beneath the umbrella.

Referring to FIGS. 1 and 2, there is shown a windproof umbrella with double canopy and a single frame constructed in accordance with the invention comprising a frame 1 and a canopy 2 including an upper canopy 20 and a lower canopy 22, each consists of a plurality of sectors each having a generally leaf configuration along the periphery of the umbrella.

The frame 1 comprises a shank 10, a stationary hub 12, a ring 14, a plurality of first ribs 121 for supporting upper canopy 20 having one ends attached to the stationary hub 12, a plurality of second ribs 122 for supporting lower canopy 22 also having one ends attached to the stationary hub 12, a plurality of first spreaders 141 having one ends attached to the ring 14, and a plurality of second spreaders 142 also having one ends attached to the ring 14. As best seen in FIG. 2, first ribs 121 are supported by first spreaders 141, while second ribs 122 are supported by second spreaders 142. First ribs 121 and second ribs 122 are alternate, while first spreaders 141 and second rings 142 are also alternate. This forms a single frame. It is understood that first ring 14 can move along the shank 10 such that the stretching and folding of upper canopy 20 and lower canopy 22 can be smooth and synchronous. Further, a substantially polygonal (e.g., octagonal) vent hole 221 is provided in the center portion of the lower canopy 22. The provision of vent hole 221 in the center portion of the lower canopy 22 is based on the fact that this center portion has the smallest stirring of air beneath umbrella when a person holds an umbrella walking under the hot sun.

Also, each of upper and lower canopies 20 and 22 consists of a plurality of sectors each having a generally triangular recess along the periphery of the umbrella. Upper canopy 20 is in covering relation to the lower canopy 22. The sectors of upper canopy 20 and lower canopy 22 are alternate.

As to ventilation, according to the principles of air dynamics, it is known that wind will move from a high pressure region to a low one. It is also known that the air pressure beneath umbrella is lower than that above umbrella when a person holds an umbrella in walking.

Figure 3:
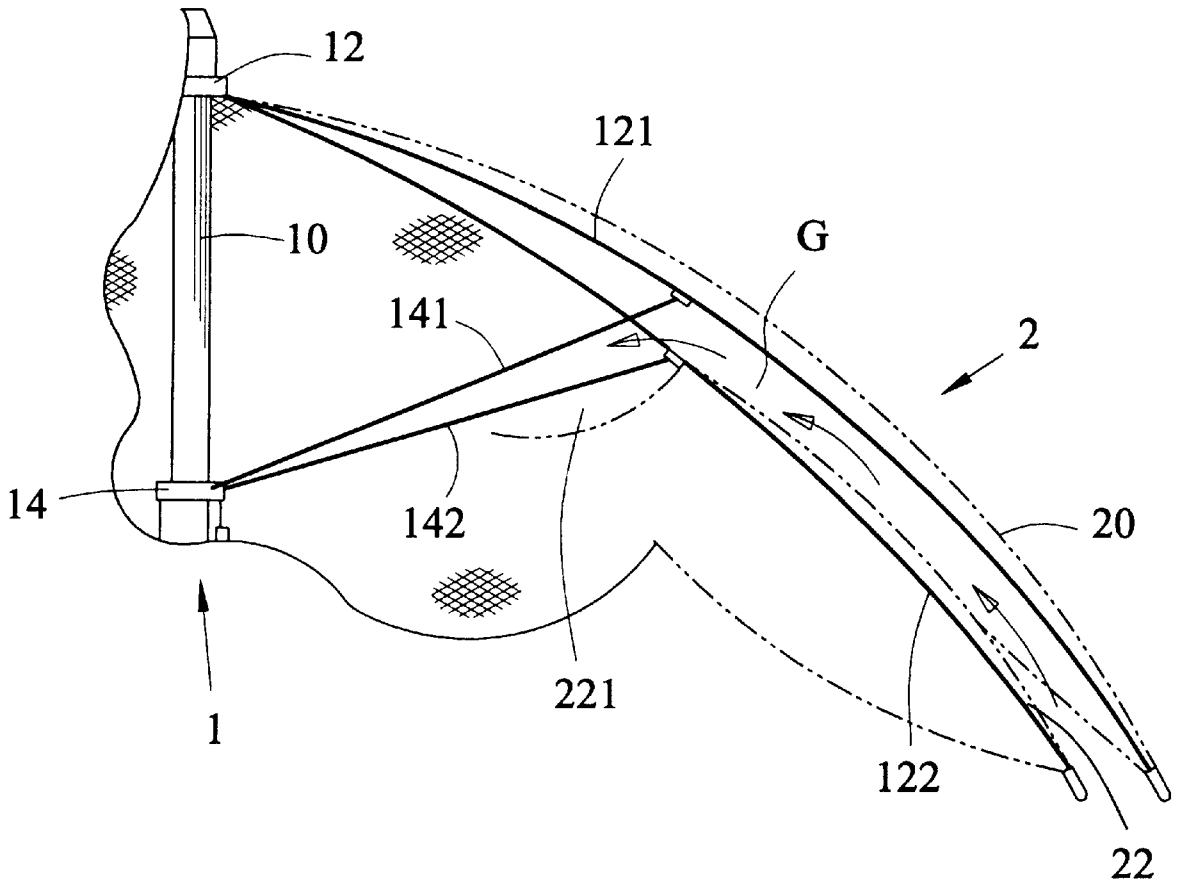
FIG. 3 is a partial cross-sectional view of FIG. 1 showing wind passed from above umbrella through canopy into umbrella.

Referring to FIG. 3, it is apparent that a gap G exists between the upper canopy 20 and the lower canopy 22. In hot summer days, air, as best indicated by arrows, above umbrella may pass through gap G and vent hole 221 to enter into umbrella. This has the effect of ventilation, thus much eliminating the hot and damp air beneath the umbrella.

Figure 4:
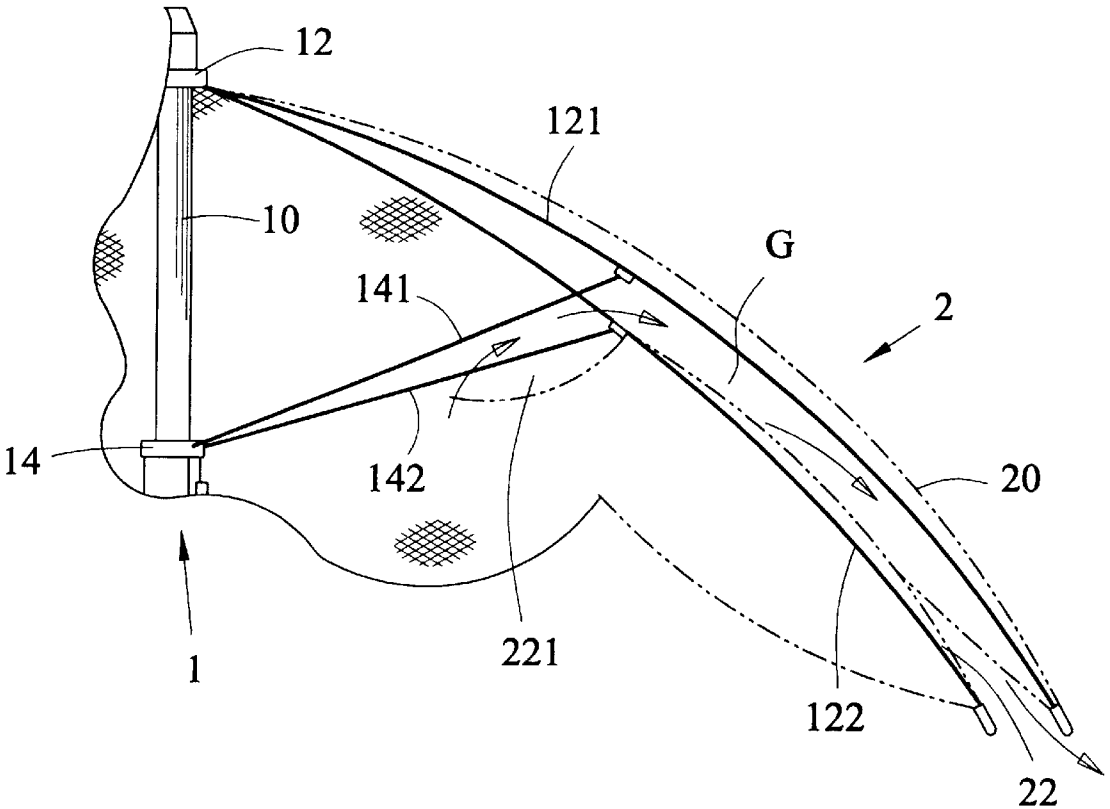
FIG. 4 is similar to FIG. 3, showing wind passed from beneath umbrella through canopy to the outside.

Referring to FIG. 4, during windy weather, wind, as best indicated by arrows, that is caught beneath the lower canopy 22 through the vent hole 221 and applies pressure to the upper canopy 20. This forces the upper canopy 20 lift away from the lower canopy 22 a predetermined distance to provide a path through the gap G for the wind to escape the upper canopy 20. This can effectively release pressure of the strong wind beneath umbrella, thus preventing inversion.

Figure 5B:
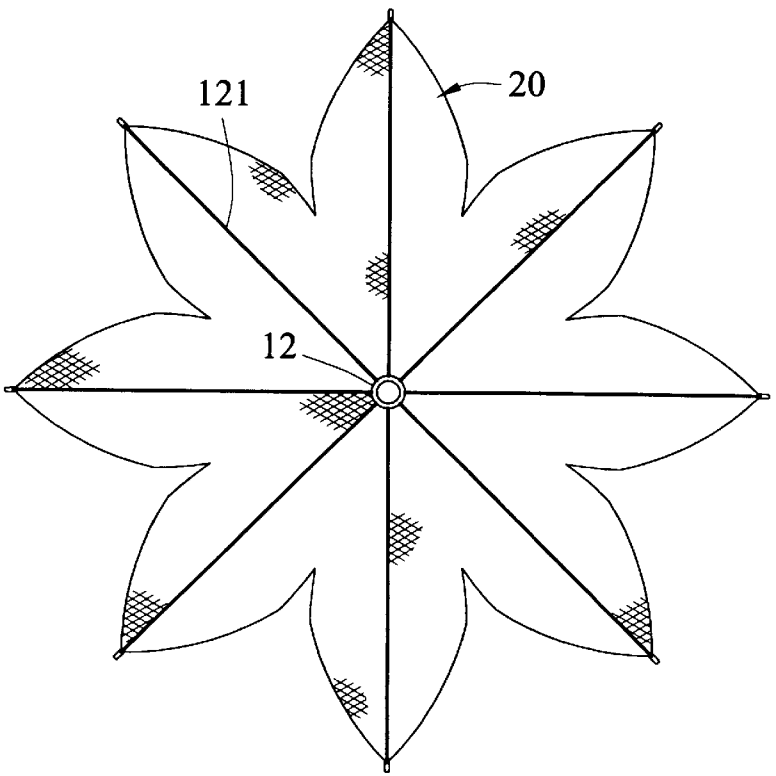
FIG. 5B is a top plan view of upper canopy of FIG. 1.
Figure 5A:
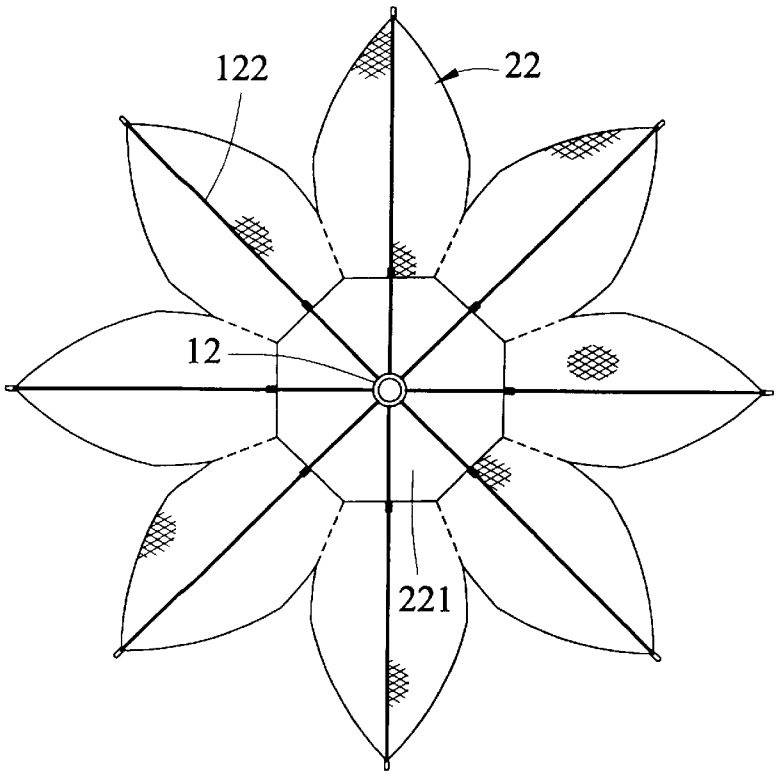
FIG. 5A is a top plan view of lower canopy of FIG. 1.

Referring to FIGS. 5A and 5B, upper canopy 20 is stretched over first ribs 121, while lower canopy 22 is stretched over second ribs 122.

Figure 6:
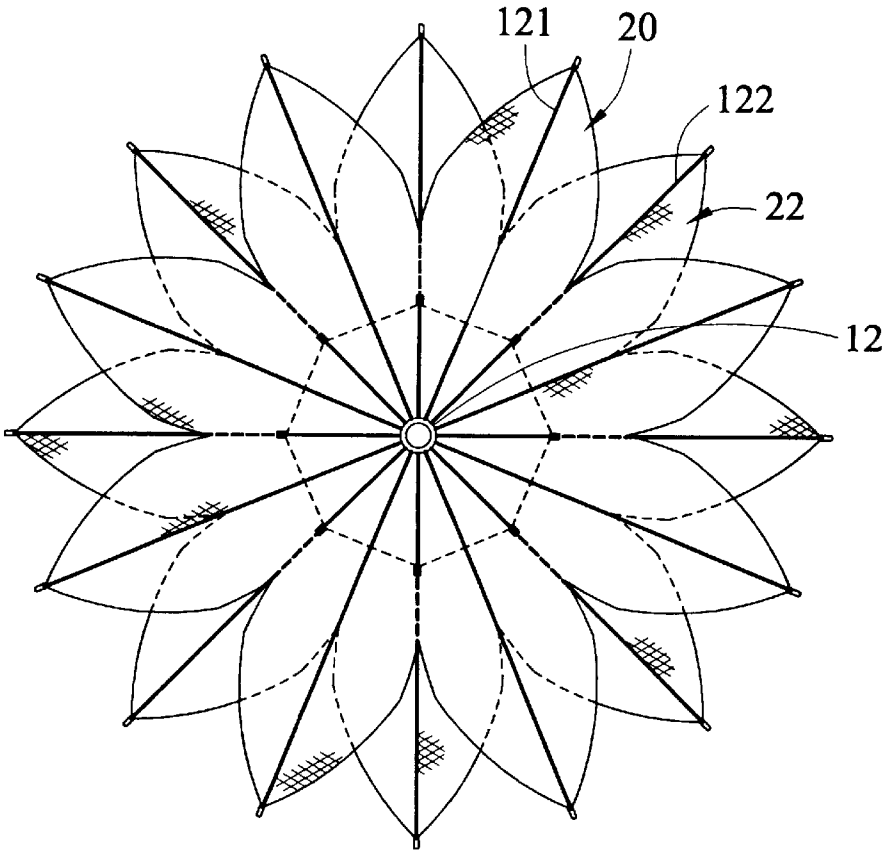
FIG. 6 is a top plan view showing the covering relation of the stretched upper canopy to lower canopy.

Referring to FIG. 6, this top plan view shows the covering relation of stretched upper canopy 20 to lower canopy 22. It is apparent that the sectors of upper canopy 20 and lower canopy 22 are alternate.

Figure 7:
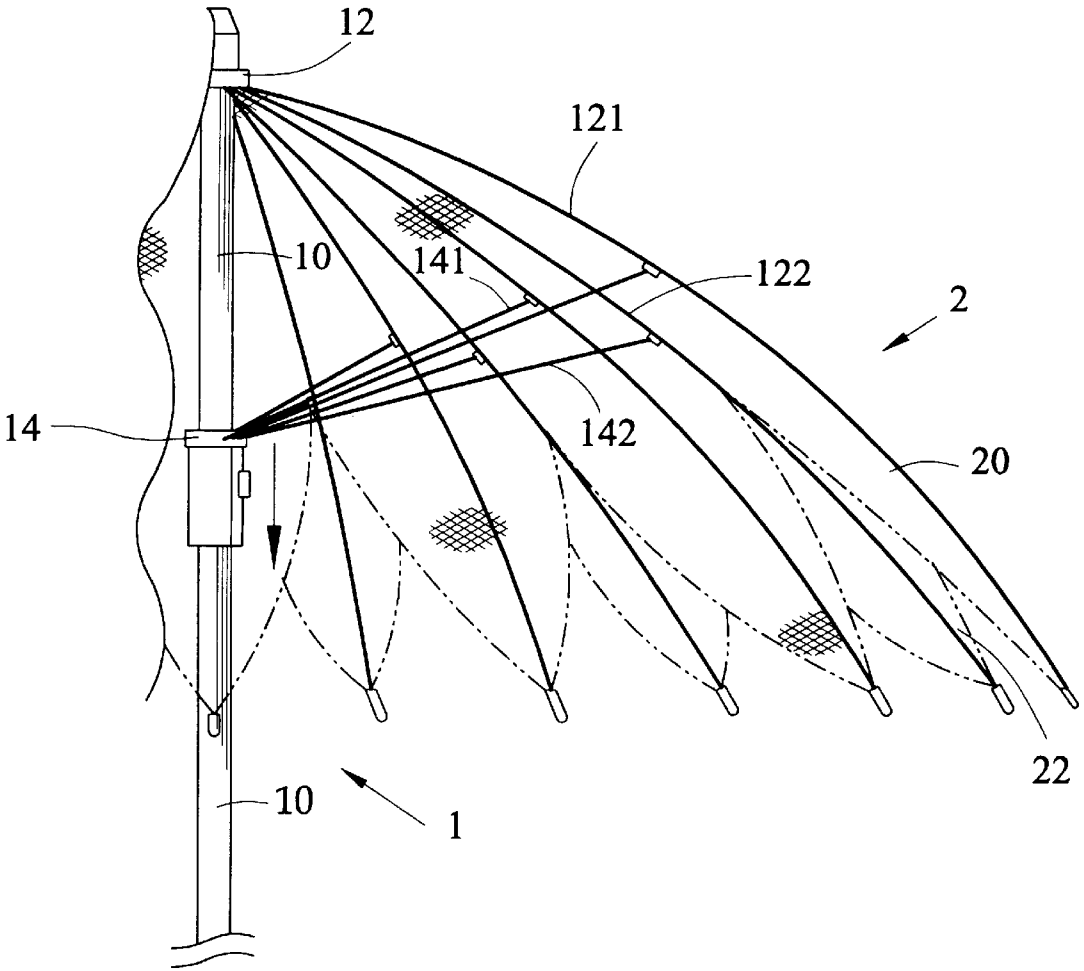
FIG. 7 is showing the operation of umbrella of FIG. 1.

Referring to FIG. 7, this view shows the operation of umbrella of FIG. 1. In detail, the stationary hub 12 is fixed on the upper portion of shank 10, while the ring 14 is slidably fixed along the shank 10. First ribs 121 and second ribs 122 have one ends attached to the stationary hub 12, and the other free ends equally spaced around the periphery of umbrella. Similarly, first spreaders 141 and second spreaders 142 have one ends attached to the ring 14, and the other free ends equally spaced around the periphery of umbrella. First ribs 121 are supported by first spreaders 141, while second ribs 122 are supported by second spreaders 142. This forms a single frame of a stretched umbrella.

It is understood that the stretching and folding of upper canopy 20 and lower canopy 22 can be smooth and synchronous because, as stated above, the ring 14 is smoothly slidable along the shank 10 as well as first ribs 121 and second ribs 122 are also equally spaced around the periphery of umbrella.

It is designed that upper canopy 20 and lower canopy 22 are not equal in size. Further, upper canopy 20 is larger than lower canopy 22 in above embodiments. While it is appreciated by those skilled in the art that lower canopy 22 may be larger than upper canopy 22 without departing from the scope and spirit of the invention.

While the invention herein disclosed has been described by means of specific embodiments, numerous modifications and variations could be made thereto by those skilled in the art without departing from the scope and spirit of the invention set forth in the claims.

What is claimed is:

1. A windproof umbrella comprising:

a canopy including an upper canopy and a spaced apart lower canopy, wherein the upper canopy is larger than the lower canopy and is in covering relation to the lower canopy;

a vent hole provided in a center portion of the lower canopy; and a frame including a shank, a stationary hub fixed on an upper portion of the shank, a ring slidable along the shank, a plurality of first ribs supporting only the upper canopy, each having one end attached to the stationary hub, a plurality of second ribs supporting only the lower canopy, each having one end also attached to the stationary hub wherein each attached position of the second ribs is positioned next to that of the first ribs, a plurality of first spreaders each having one end attached to the ring, and a plurality of second spreaders each having one end also attached to the ring wherein each attached position of second spreaders is positioned next to that of the first spreaders, wherein adjacent ribs and adjacent stretchers are attached to the respective hub and the respective ring at a common point along a length of the shank, and wherein air beneath the lower canopy exits through a gap formed between the upper and the lower canopies when the frame is stretched; and free ends of the first ribs, the second ribs, the first spreaders, and the second spreaders are equally spaced around a periphery of the umbrella such that the stretching and the folding of the upper canopy and the lower canopy are smooth and synchronous.

2. The windproof umbrella of claim 1, wherein the upper canopy comprises a plurality of sectors each having a generally leaf configuration along the periphery of the umbrella.

3. The windproof umbrella of claim 1, wherein the lower canopy comprises a plurality of sectors each having a generally leaf configuration along the periphery of the umbrella.

* * * * *